US007298099B2

(12) United States Patent
Ribarich

(10) Patent No.: US 7,298,099 B2
(45) Date of Patent: Nov. 20, 2007

(54) PFC AND BALLAST CONTROL IC

(75) Inventor: Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 32 days.

(21) Appl. No.: 11/102,603

(22) Filed: Apr. 8, 2005

(65) Prior Publication Data

US 2005/0225265 A1 Oct. 13, 2005

Related U.S. Application Data

(60) Provisional application No. 60/560,875, filed on Apr. 8, 2004.

(51) Int. Cl.
*H05B 37/02* (2006.01)

(52) U.S. Cl. ..... 315/308; 315/360

(58) Field of Classification Search ..... 315/209 R, 315/224, 225, 226, 291, 307, 308, 360; 361/88, 361/89, 90, 91.1, 91.2, 91.3
See application file for complete search history.

(56) References Cited

U.S. PATENT DOCUMENTS

| | | | | |
|---|---|---|---|---|
| 6,008,593 | A * | 12/1999 | Ribarich | 315/307 |
| 2002/0047635 | A1* | 4/2002 | Ribarich et al. | 315/291 |
| 2004/0113569 | A1* | 6/2004 | Henry | 315/307 |
| 2005/0156534 | A1* | 7/2005 | Oh | 315/247 |

FOREIGN PATENT DOCUMENTS

| | | |
|---|---|---|
| EP | 1 395 095 | 3/2004 |
| WO | 2004/006630 | 1/2004 |

OTHER PUBLICATIONS

U.K. Office Action in corresponding U.K. Application No. GB0621355.7 issued Feb. 23, 2007.

* cited by examiner

*Primary Examiner*—Trinh Dinh
*Assistant Examiner*—Dieu Hien T Duong
(74) *Attorney, Agent, or Firm*—Ostrolenk, Faber, Gerb & Soffen, LLP

(57) ABSTRACT

The IRS21681D is a fully integrated, fully protected 600V ballast control IC designed to drive all types of fluorescent lamps. The IRS21681D is based on the popular IR2166 control IC with additional improvements to increase ballast performance. PFC circuitry operates in critical conduction mode and provides high PF, low THD and DC bus regulation. The IRS21681D features include programmable preheat and run frequencies, programmable preheat time, programmable ignition ramp, programmable PFC over-current protection, and programmable end-of-life protection. Comprehensive protection features such as protection from failure of a lamp to strike, filament failures, end-of-life protection, DC bus under-voltage reset as well as an automatic restart function, have been included in the design. The IRS2168D has, in addition, closed-loop half-bridge ignition current regulation and a novel fault counter. The IRS21681D, unlike the IRS2168D, ramps up during ignition and shuts down at the first over-current fault. The IRS21681D and IRS2168D are both available in either 16-pin PDIP or 16-pin narrow body SOIC packages.

43 Claims, 15 Drawing Sheets

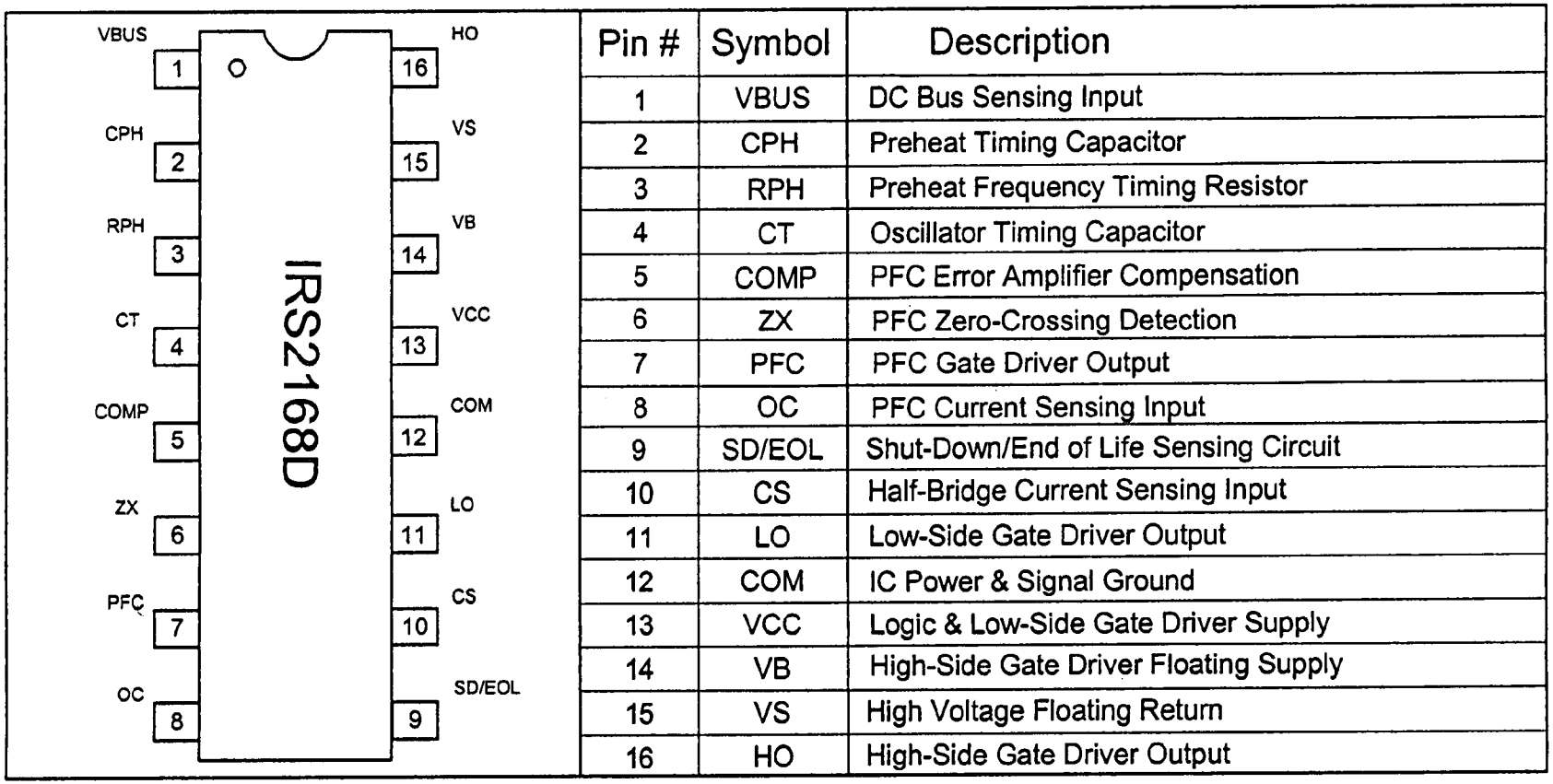

| Pin # | Symbol | Description |
|---|---|---|
| 1 | VBUS | DC Bus Sensing Input |
| 2 | CPH | Preheat Timing Capacitor |
| 3 | RPH | Preheat Frequency Timing Resistor |
| 4 | CT | Oscillator Timing Capacitor |
| 5 | COMP | PFC Error Amplifier Compensation |
| 6 | ZX | PFC Zero-Crossing Detection |
| 7 | PFC | PFC Gate Driver Output |
| 8 | OC | PFC Current Sensing Input |
| 9 | SD/EOL | Shut-Down/End of Life Sensing Circuit |
| 10 | CS | Half-Bridge Current Sensing Input |
| 11 | LO | Low-Side Gate Driver Output |
| 12 | COM | IC Power & Signal Ground |
| 13 | VCC | Logic & Low-Side Gate Driver Supply |
| 14 | VB | High-Side Gate Driver Floating Supply |
| 15 | VS | High Voltage Floating Return |
| 16 | HO | High-Side Gate Driver Output |

FIG. 6

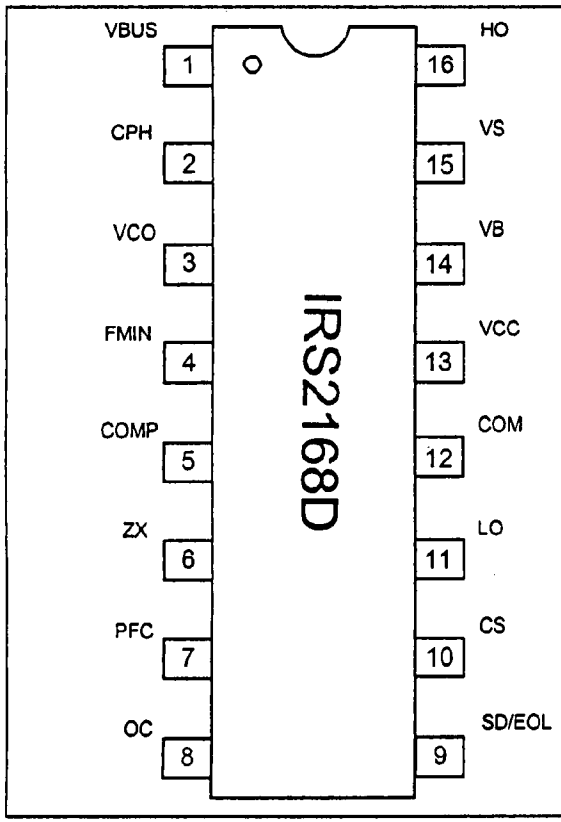

| Pin # | Symbol | Description |
|---|---|---|
| 1 | VBUS | DC Bus Sensing Input |
| 2 | CPH | Preheat Timing Input |
| 3 | VCO | Voltage Controlled Oscillator/Ignition Ramp Input |
| 4 | FMIN | Oscillator Minimum Frequency Setting |
| 5 | COMP | PFC Error Amplifier Compensation |
| 6 | ZX | PFC Zero-Crossing Detection |
| 7 | PFC | PFC Gate Driver Output |
| 8 | OC | PFC Current Sensing Input |
| 9 | SD/EOL | Shut-Down/End of Life Sensing Input |
| 10 | CS | Half-Bridge Current Sensing Input |
| 11 | LO | Low-Side Gate Driver Output |
| 12 | COM | IC Power & Signal Ground |
| 13 | VCC | Logic & Low-Side Gate Driver Supply |
| 14 | VB | High-Side Gate Driver Floating Supply |
| 15 | VS | High Voltage Floating Return |
| 16 | HO | High-Side Gate Driver Output |

FIG. 7

PFC AND BALLAST CONTROL IC

CROSS REFERENCE TO RELATED APPLICATIONS

The present application is based upon and claims priority of provisional application No. 60/560,875, filed Apr. 8, 2004, incorporated by reference.

It is related to U.S. Provisional Application 60/482,334 (IR-2199 PROV) filed Jun. 24, 2003, incorporated by reference in its entirety. The '334 provisional includes detailed descriptions of the IR2166(S) and IR2167(S) PFC Ballast Control IC's which are of background interest in this case. The '334 provisional also refers to U.S. Pat. No. 6,617,805 and several other patents and published articles, all incorporated by reference. See also Ser. No. 10/875,474 filed Jun. 23, 2004; and Ser. No. 10/615,710 filed Jul. 8, 2003, both incorporated by reference.

BACKGROUND OF THE INVENTION

1. Field of the Invention

The present invention relates to a ballast control IC, particularly for driving fluorescent lamps, and more particularly with additional PFC circuitry on the IC.

2. Related Art

Several aspects of the invention may provide additional functionality and reliability to the popular IR2166 and IR2167 ballast control IC's , both manufactured by the International Rectifier Corporation. Descriptions are available at www.irf.com, as well as in the above-mentioned related application and articles, especially Ser. No. 60/482,344. Detailed descriptions of the background art are thus freely available and need not be included herein.

SUMMARY OF THE INVENTION

Several aspects of the invention are embodied in the International Rectifier IRS21681D and IRS2168D Power Factor Correction and Ballast Control IC's, and also may be adaptable to other devices and environments by those having skill in the art.

The IRS21681D is a fully integrated, fully protected 600V ballast control IC designed to drive all types of fluorescent lamps. The IRS21681D is based on the popular IR2166 control IC with additional improvements to increase ballast performance. PFC circuitry operates in critical conduction mode and provides high PF, low THD and DC bus regulation. The IRS21681D features include programmable preheat and run frequencies, programmable preheat time, programmable ignition ramp, programmable PFC over-current protection, and programmable end-of-life protection. Comprehensive protection features such as protection from failure of a lamp to strike, filament failures, end-of-life protection, DC bus under-voltage reset as well as an automatic restart function, have been included in the design.

The IRS2168D has, in addition, closed-loop half-bridge ignition current regulation and a novel fault counter. The IRS21681D, unlike the IRS2168D, ramps up during ignition and shuts down at the first over-current fault.

Referring to the IRS21681D state diagram, FIG. 4, it is seen that only a single event of CS pin >1.25V is needed to go to fault mode from ignition or run mode. In the preheat mode, the CS pin over-current is disabled. In the timing diagram, FIG. 8, see the zoomed images at the bottom. The middle image shows the ignition ramp and it can be seen that the current ramps up and the ballast shuts off (fault mode) as soon as CS>1.25V.

Referring to the IRS2168D state diagram, FIG. 5, it can be seen that the CS pin over-current is enabled in preheat mode and run mode, but that 60 cycles of consecutive faults (internal fault counter) are needed in order to go to fault mode. During ignition, fault mode is disabled. Instead, the ignition regulation circuit keeps the CS pin limited to 1.25V, and therefore limits the maximum ignition current and voltage of the ballast output stage. See also the timing diagram, FIG. 9, which shows that the current is regulated for the duration of ignition.

The IRS21681D and IRS2168D are both available in either 16-pin PDIP or 16-pin narrow body SOIC packages.

Features of the IC's are summarized as follows:

PFC, ballast control and half-bridge driver in one IC
Critical-conduction mode boost-type PFC
Programmable PFC over-current protection
Programmable half-bridge over-current protection
Programmable preheat frequency
Programmable preheat time
Programmable ignition ramp
Programmable run frequency
Voltage-controlled oscillator (VCO)
End-of-life window comparator pin
DC bus under-voltage reset
Lamp removal/auto-restart shutdown pin
Internal bootstrap MOSFET
Internal 15.8V (15.6V in the IRS2168D) zener clamp diode on Vcc
Micropower startup (200 μA)
Latch immunity and ESD protection The IRS2168D has, in addition:

Closed-loop current regulation
Internal 60-event current sense up/down fault counter IRS21681D vs. IR2166 Comparison New PFC Over-current sensing pin
Improved VBUS regulation voltage tolerance
Increased PFC on-time range
Decreased PFC minimum on-time
New VCO oscillator and programmable ignition ramp
Fixed internal 1.2 μs (1.4 μs in the IRS2168D) HO and LO deadtime
No CPH internal charging current (RCPH connected to VCC)
No fault counter (In the IRS2168D, CS pin fault counter is active in all modes except ignition)
Single-event over-current enabled during ignition and run (new closed-loop ignition current regulation in the IRS2168D)
Increased SD pin shutdown voltage threshold hysteresis
Changed EOL pin internal 2V bias to a 30 μA OTA
Internal bootstrap MOSFET Other features and advantages of the present invention will become apparent from the following description of embodiments of the invention which refers to the accompanying drawings.

BRIEF DESCRIPTION OF THE DRAWING(S)

FIGS. 6 and 7 show lead assignments and definitions in the IRS21681D and IRS2168D, respectively.

DETAILED DESCRIPTION OF EMBODIMENTS OF THE INVENTION

The following functional descriptions will discuss primarily the IRS2168D, the differences between the two embodiments having already been mentioned.

Ballast Section

Under-Voltage Lock-Out Mode (UVLO)

Figure 1:
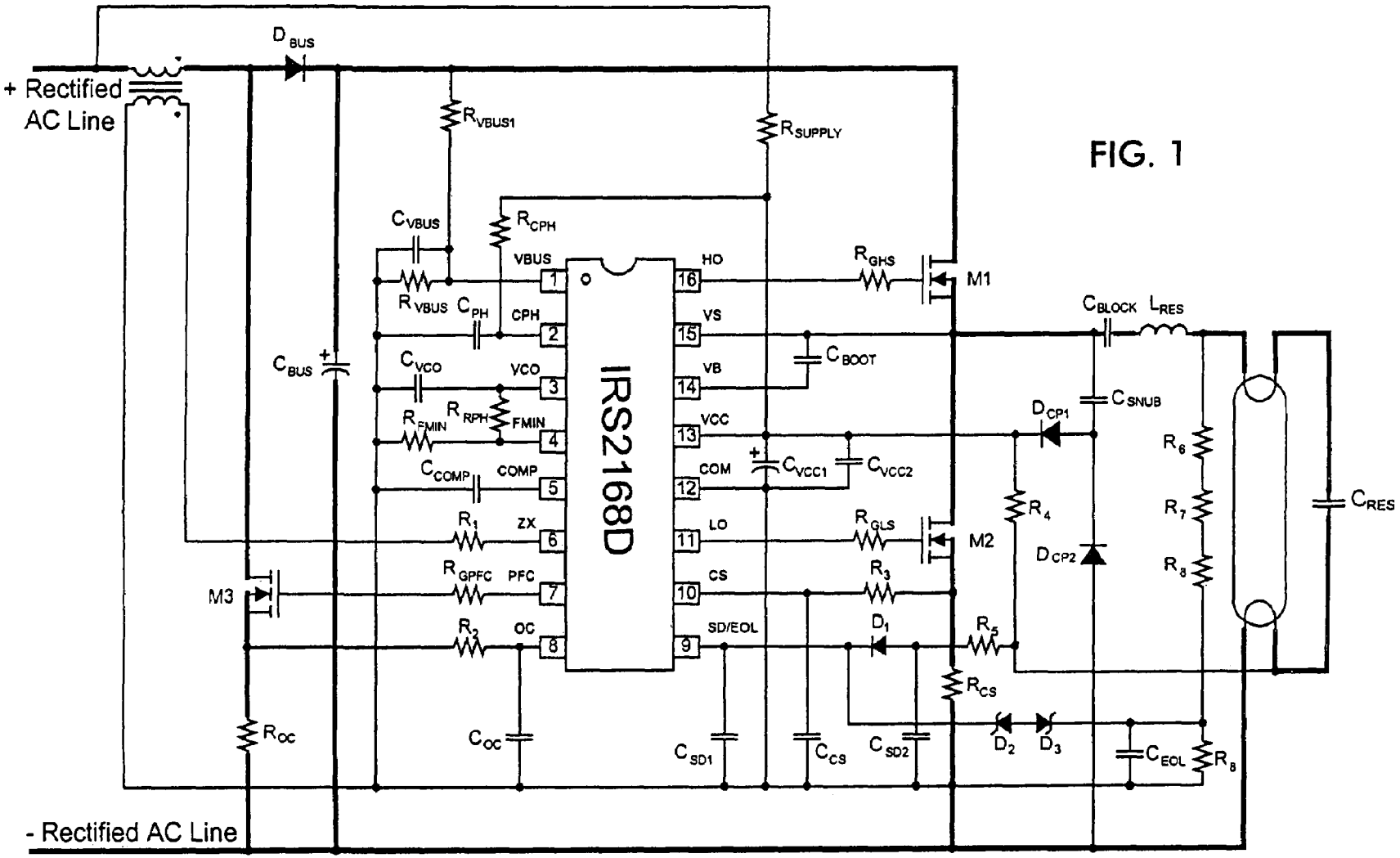
FIG. 1 is a schematic diagram showing a typical application of the IC's.
Figure 2:
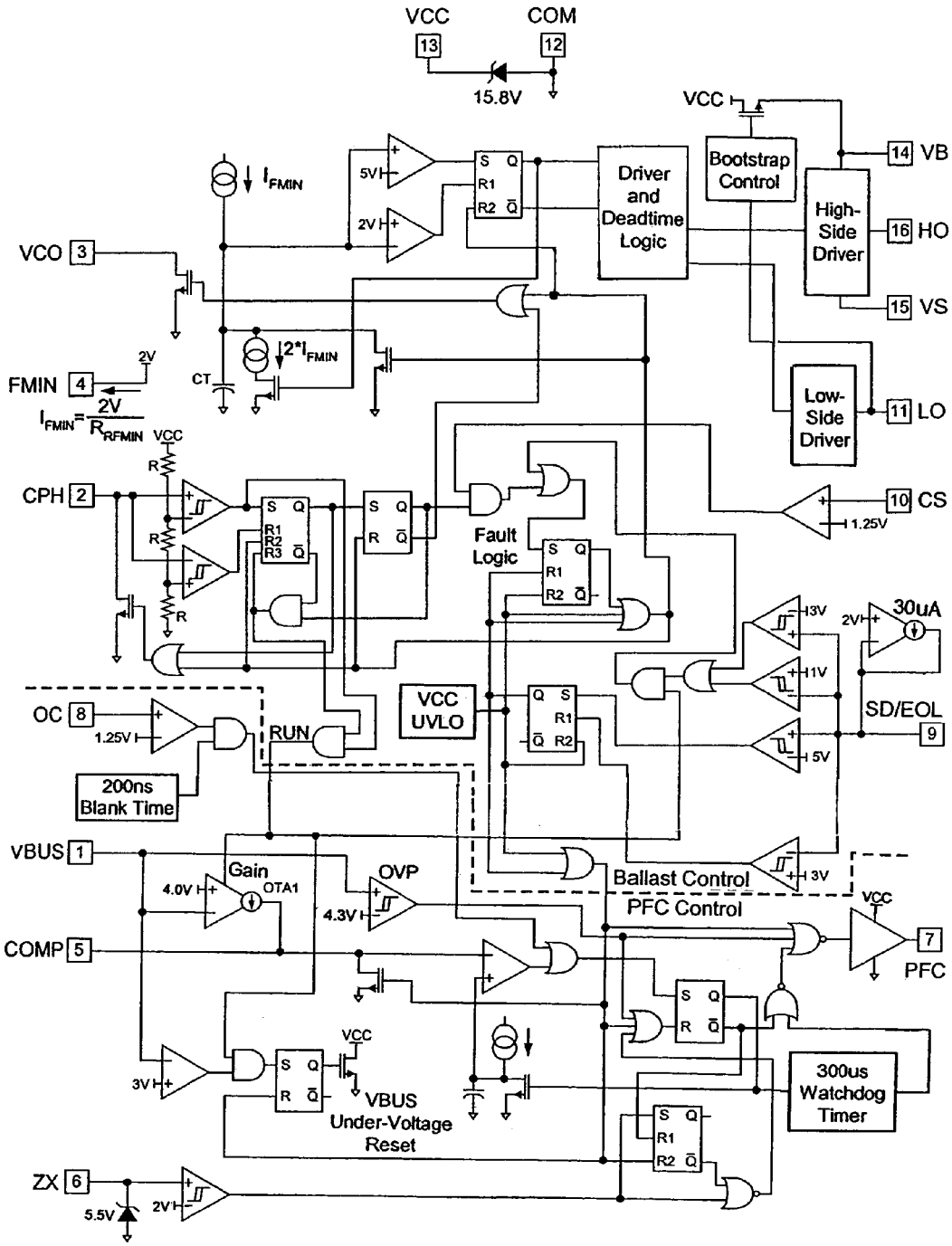
FIGS. 2 and 3 are schematic block diagrams of the IRS21681D and IRS2168D chips, respectively.
Figure 3:
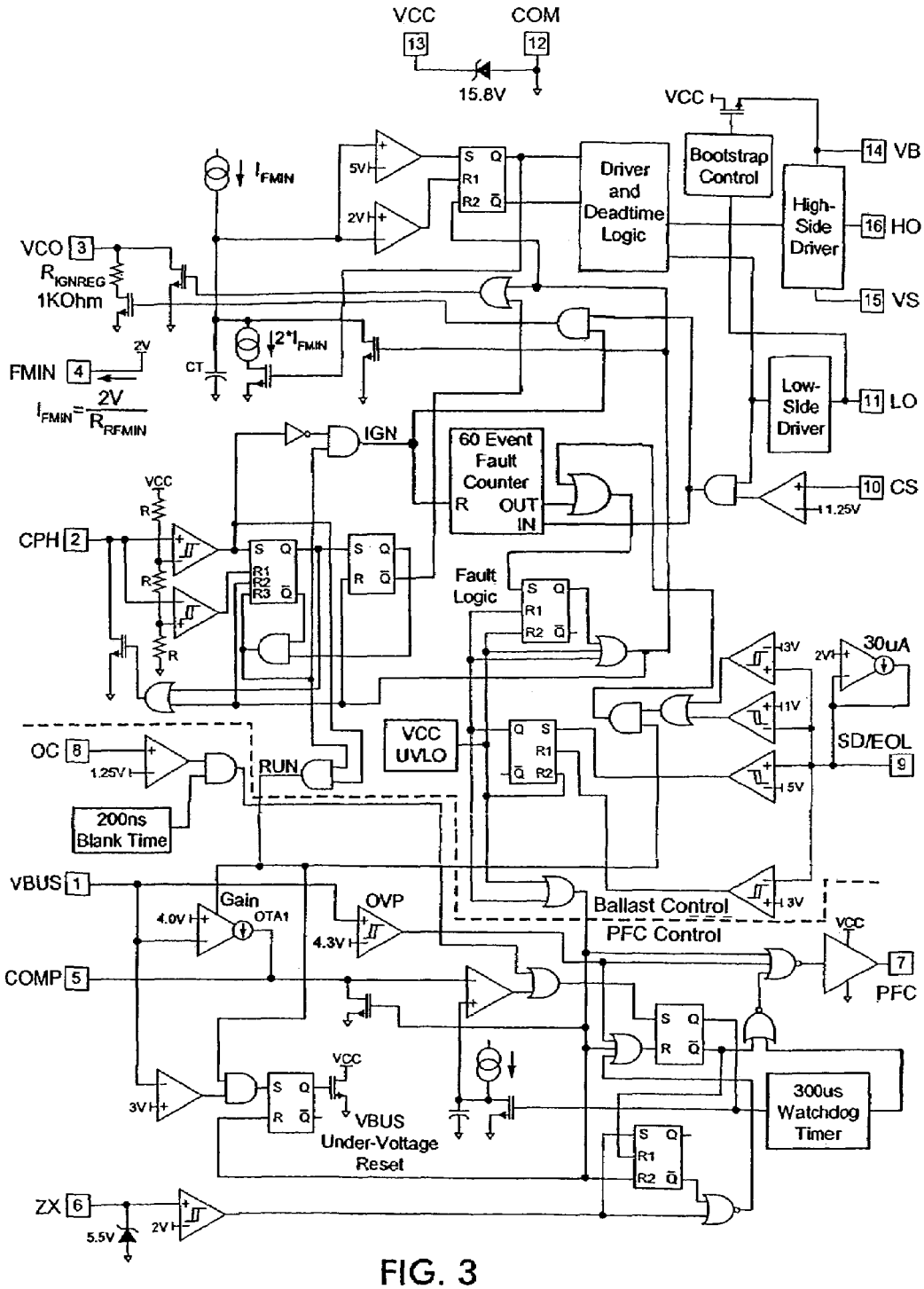
Figure 4:
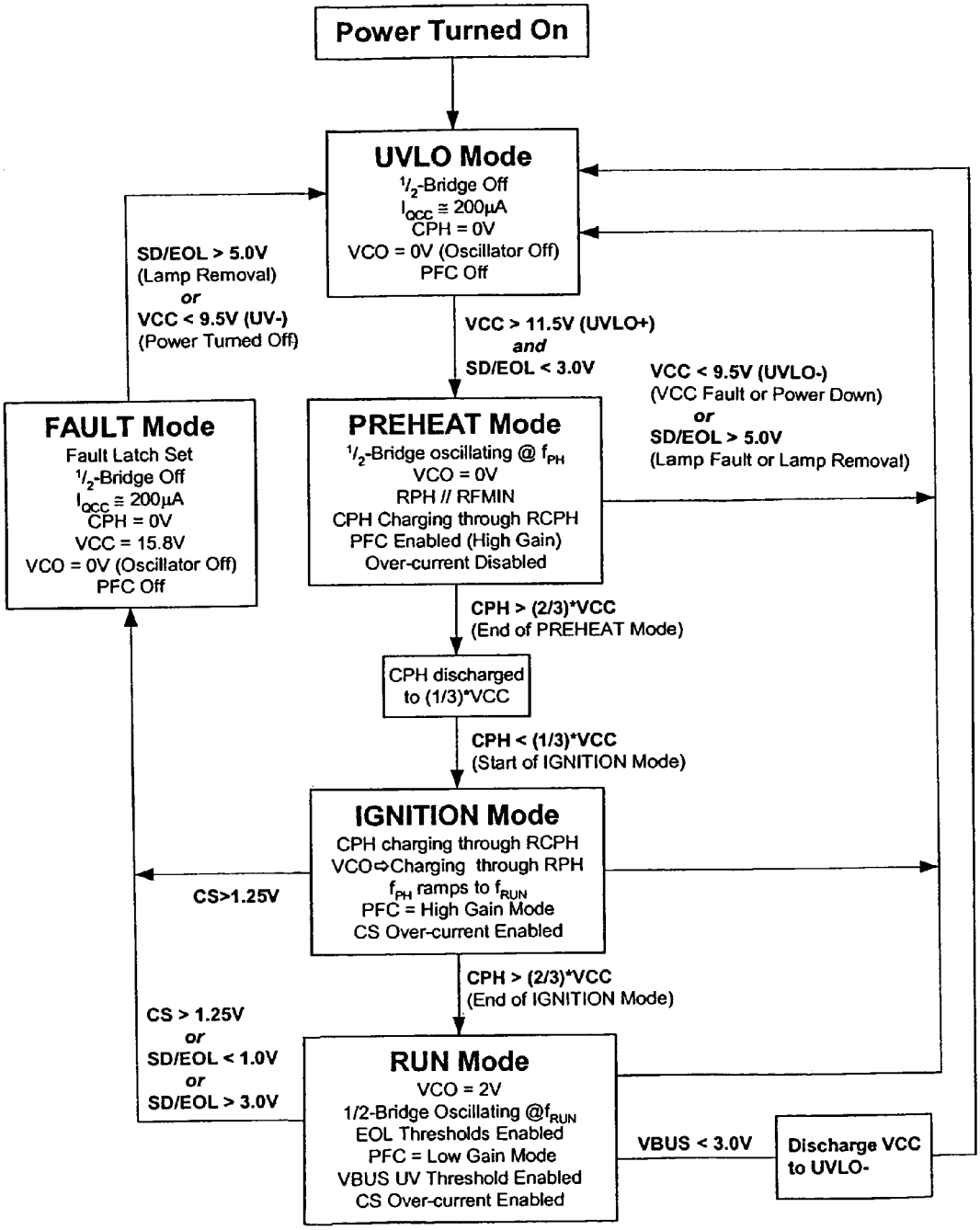
FIGS. 4 and 5 are state diagrams showing operating modes of the IRS21681D and IRS2168D, respectively.
Figure 5:
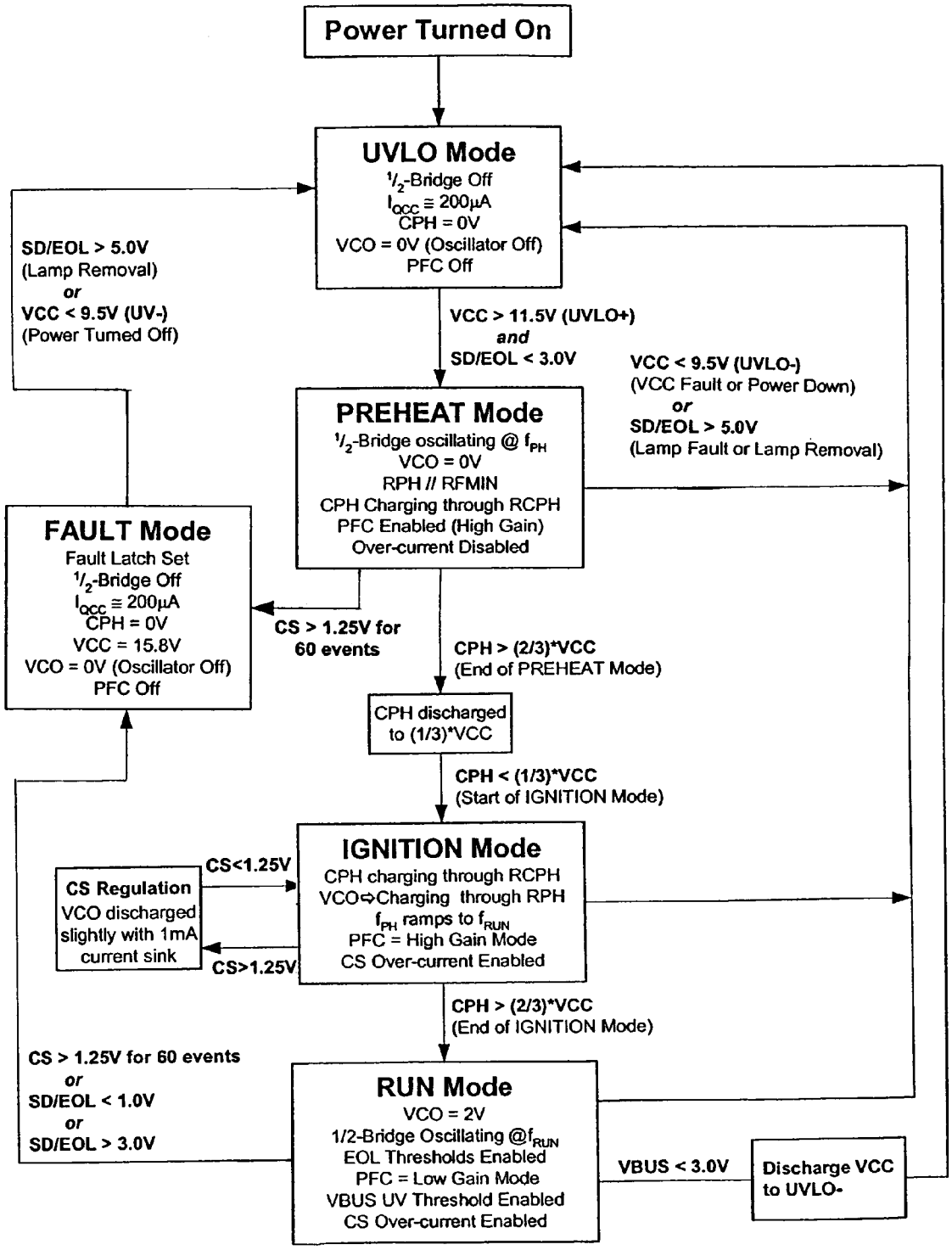
Figure 8:
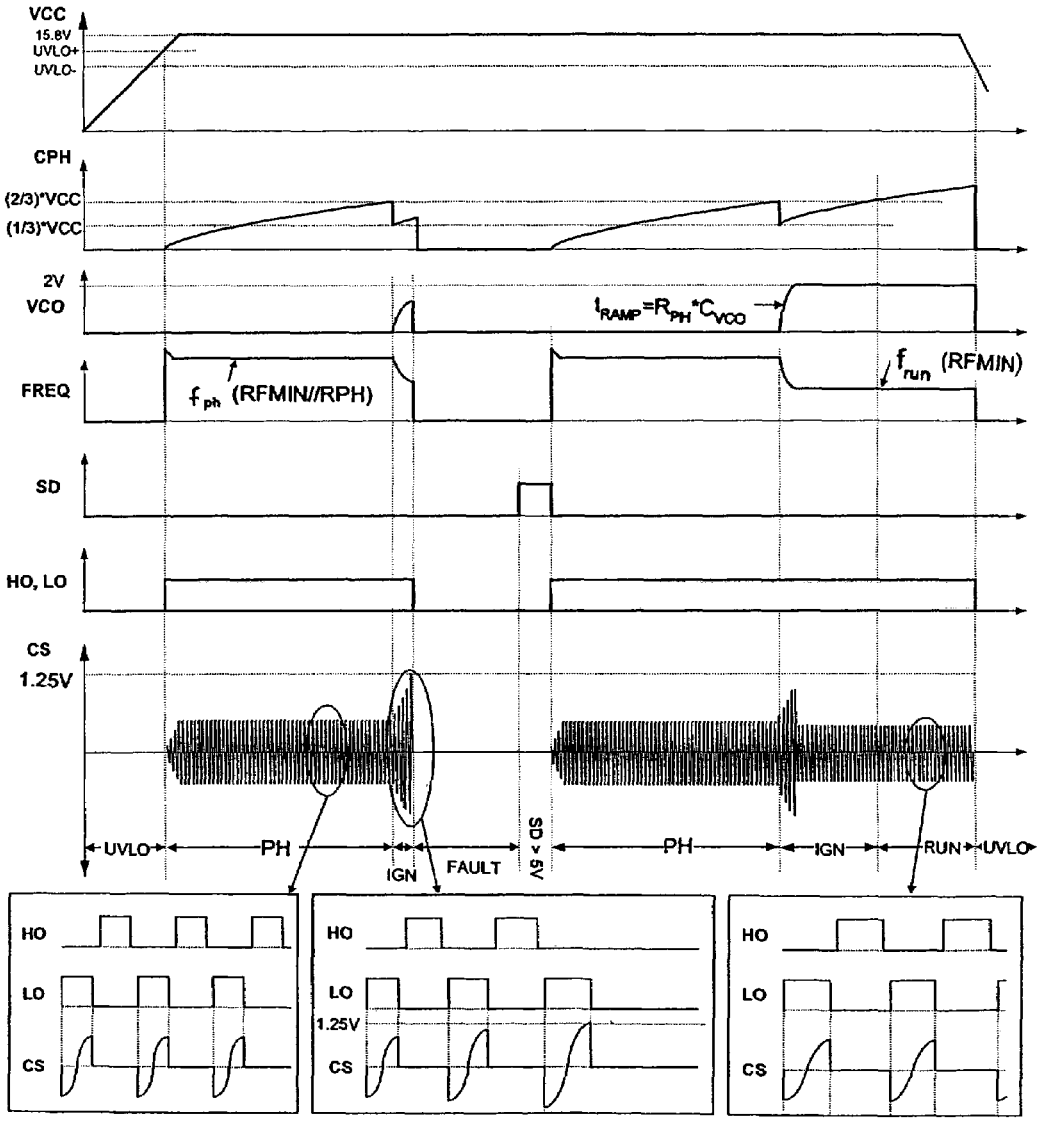
FIG. 8 shows timing diagrams for the ballast section of the IRS21681D.
Figure 9:
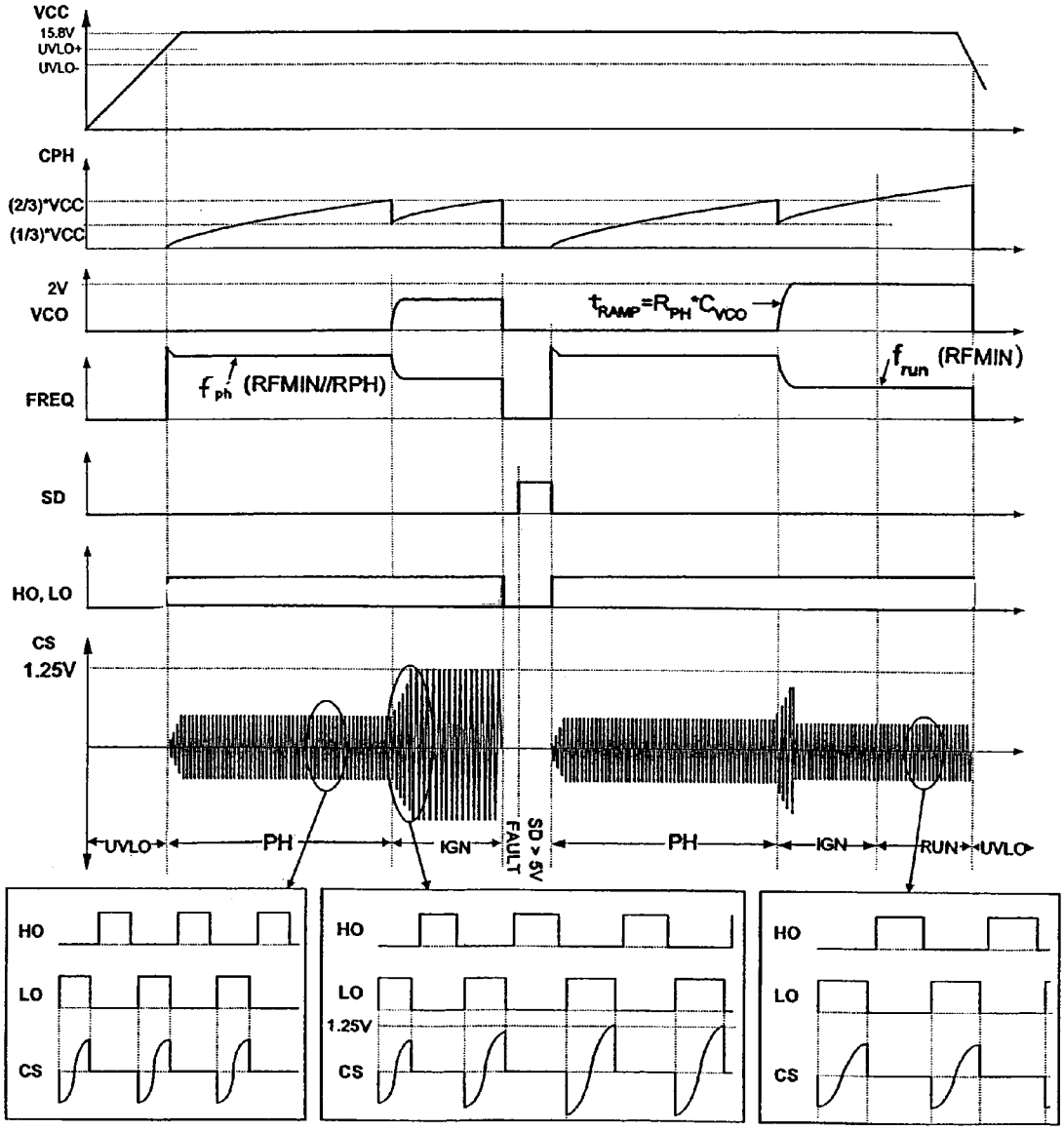
FIG. 9 shows timing diagrams for the ballast section of the IRS2168D.
Figure 10:
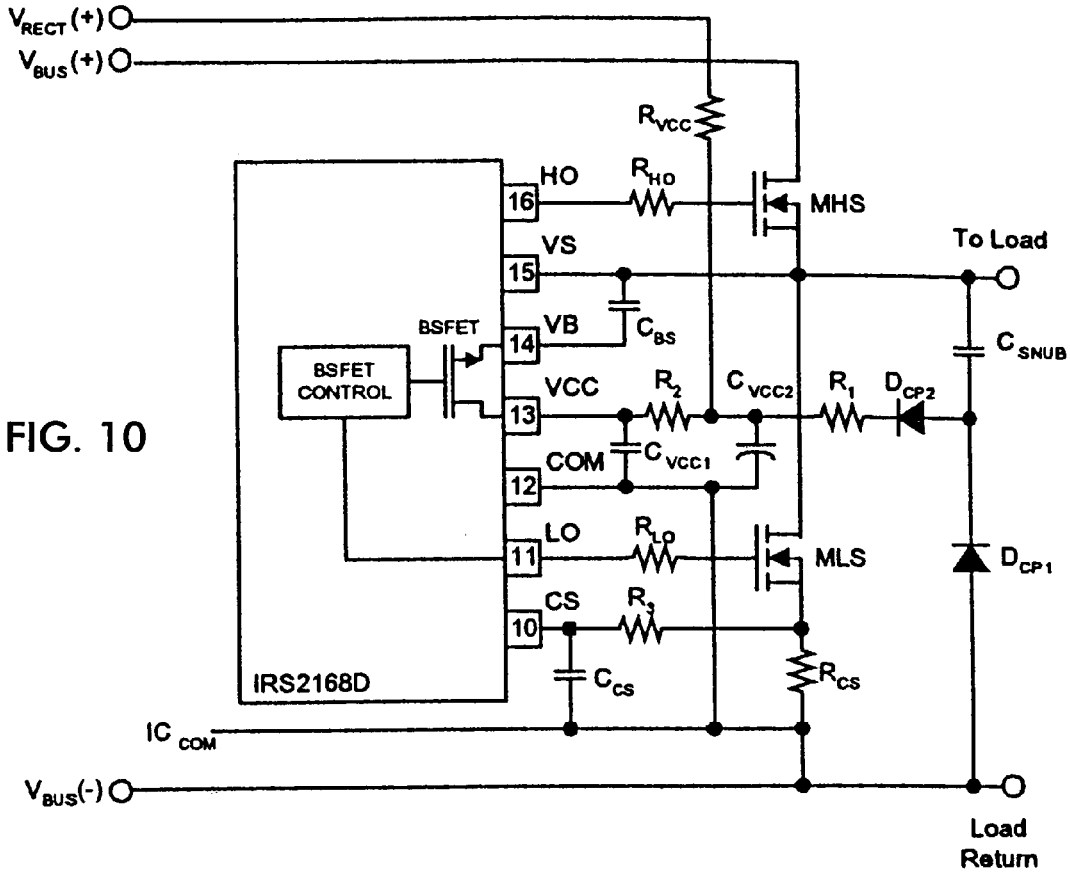
FIG. 10 shows start-up and supply circuitry.

The under-voltage lock-out mode (UVLO) is defined as the state the IC is in when VCC is below the turn-on threshold of the IC. To identify the different modes of the IC, refer to the State Diagram shown in FIG. 5. The IRS2168D undervoltage lock-out is designed to maintain an ultra low supply current of less than 400 μA, and to guarantee the IC is fully functional before the high- and low-side output drivers are activated. FIG. 10 shows an efficient voltage supply using the micro-power start-up current of the IRS2168D together with a snubber charge pump from the half-bridge output ($R_{VCC}$, $C_{VCC1}$, $C_{VCC2}$, $C_{SNUB}$, $D_{CP1}$ and $D_{CP2}$).

Figure 11:
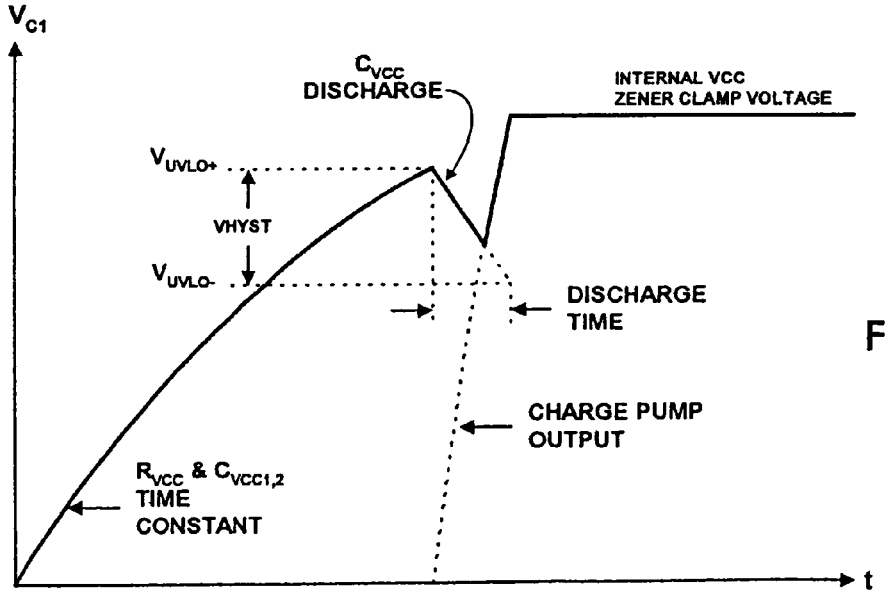
FIG. 11 is a graph showing Vcc supply voltage versus time during start-up.

The VCC capacitors ($C_{VCC1}$ and $C_{VCC2}$) are charged by the current through supply resistor ($R_{VCC}$) minus the start-up current drawn by the IC. This resistor is chosen to set the desired AC line input voltage turn-on threshold for the ballast. When the voltage at VCC exceeds the IC start-up threshold (UVLO+) and the SD pin is below 4.5 volts, the IC turns on and LO begins to oscillate. The capacitors at VCC begin to discharge due to the increase in IC operating current (FIG. 11). The high-side supply voltage, VB-VS, begins to increase as capacitor $C_{BS}$ is charged through the internal bootstrap MOSFET during the LO on-time of each LO switching cycle. When the VB-VS voltage exceeds the high-side start-up threshold (UVBS+), HO then begins to oscillate. This may take several cycles of LO to charge VB-VS above UVBS+ due to RDSon of the internal bootstrap MOSFET.

When LO and HO are both oscillating, the external MOSFETs (MHS and MLS) are turned on and off with a 50% duty cycle and a non-overlapping deadtime of 1.6 μs. The half-bridge output (pin VS) begins to switch between the DC bus voltage and COM. During the deadtime between the turn-off of LO and the turn-on of HO, the half-bridge output voltage transitions from COM to the DC bus voltage at a dv/dt rate determined by the snubber capacitor ($C_{SNUB}$). As the snubber capacitor charges, current will flow through the charge pump diode ($D_{CP2}$) to VCC. After several switching cycles of the half-bridge output, the charge pump and the internal 15.6V zener clamp of the IC take over as the supply voltage. Capacitor $C_{VCC2}$ supplies the IC current during the VCC discharge time and should be large enough such that VCC does not decrease below UVLO− before the charge pump takes over. Capacitor $C_{VCC1}$ is provided for noise filtering and is placed as close as possible and directly between VCC and COM, and should not be lower than 0.1 μF. Resistors $R_1$ and $R_2$ are recommended for limiting high currents that can flow to VCC from the charge pump during hard-switching of the half-bridge or during lamp ignition. The internal bootstrap MOSFET and supply capacitor ($C_{BS}$) comprise the supply voltage for the high side driver circuitry. During UVLO mode, the high- and low-side driver outputs HO and LO are both low, the internal oscillator is disabled, and pin CPH is connected internally to COM for resetting the preheat time.

Preheat Mode (PH)

Figure 12:
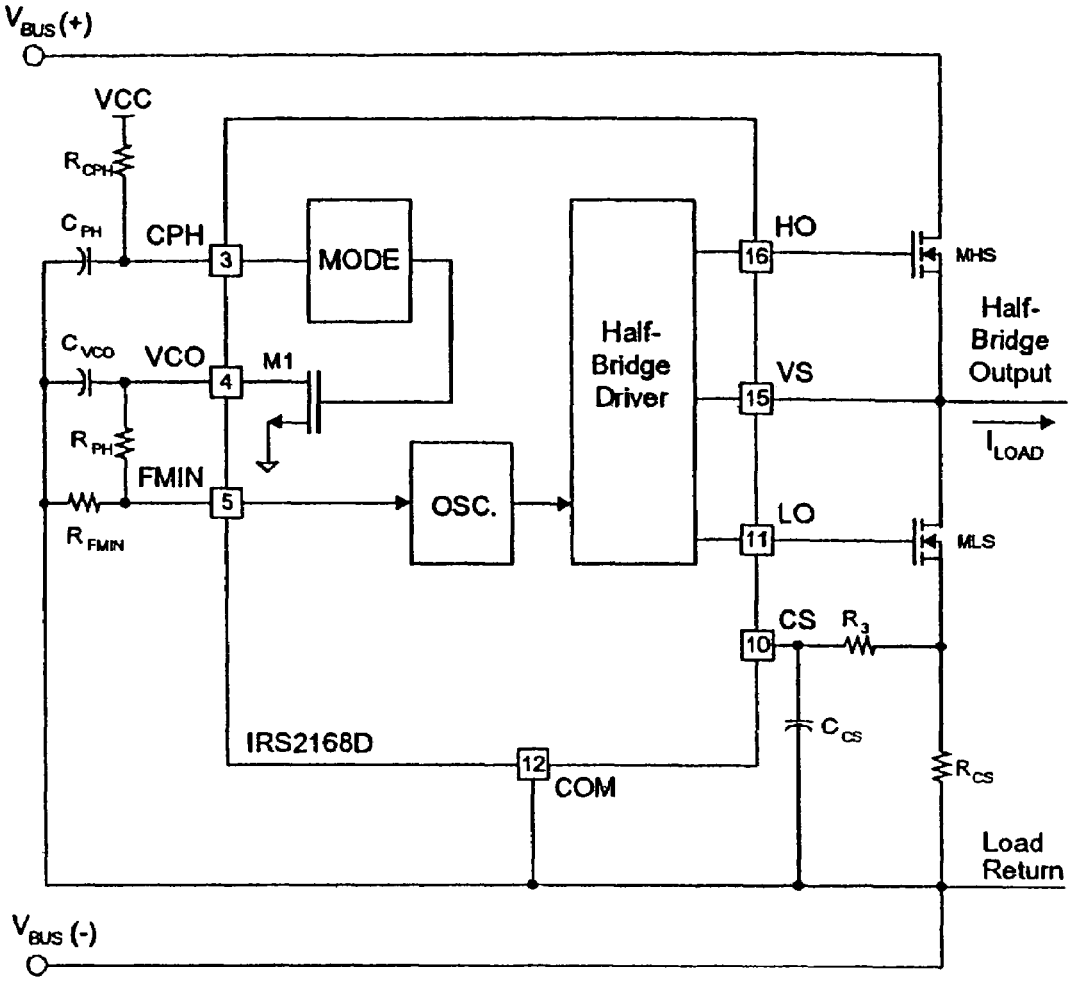
FIG. 12 is a schematic block diagram showing preheat circuitry.

The IRS2168D enters preheat mode when VCC exceeds the UVLO positive-going threshold (UVLO+). The internal MOSFET that connects pin CPH to COM is turned off and an external resistor (FIG. 12) begins to charge the external preheat timing capacitor (CPH). LO and HO begin to oscillate at a higher soft-start frequency and ramp down quickly to the preheat frequency. The VCO pin is connected to COM through an internal MOSFET so the preheat frequency is determined by the equivalent resistance at the FMIN pin formed by the parallel combination of resistors RFMIN and RPH. The frequency remains at the preheat frequency until the voltage on pin CPH exceeds ⅔*VCC and the IC enters Ignition Mode. During preheat mode, the over-current protection on pin CS and the 60-cycle consecutive over-current fault counter are both enabled. The PFC circuit is working in high-gain mode (see PFC section) and keeps the DC bus voltage regulated at a constant level.

Ignition Mode (IGN)

Figure 13:
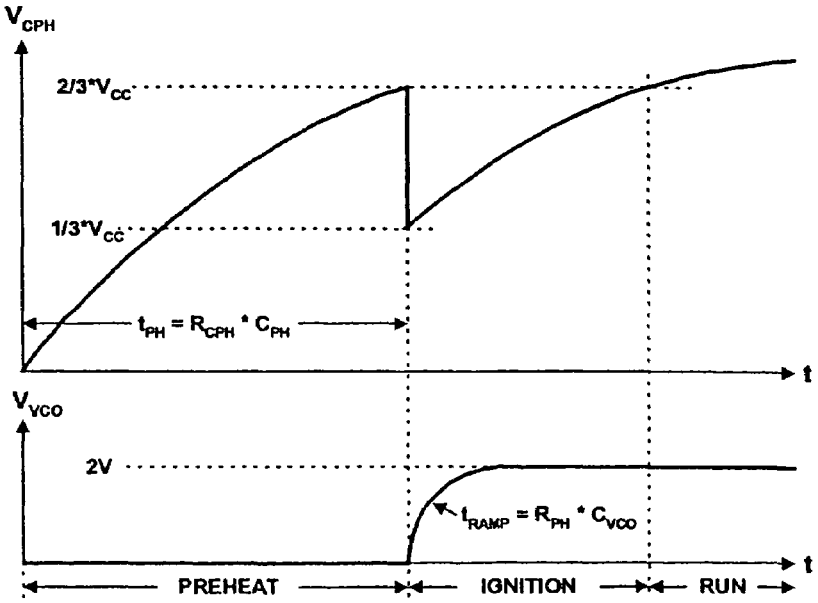
FIG. 13 is a timing diagram relative to the preheat and oscillator functions.
Figure 14:
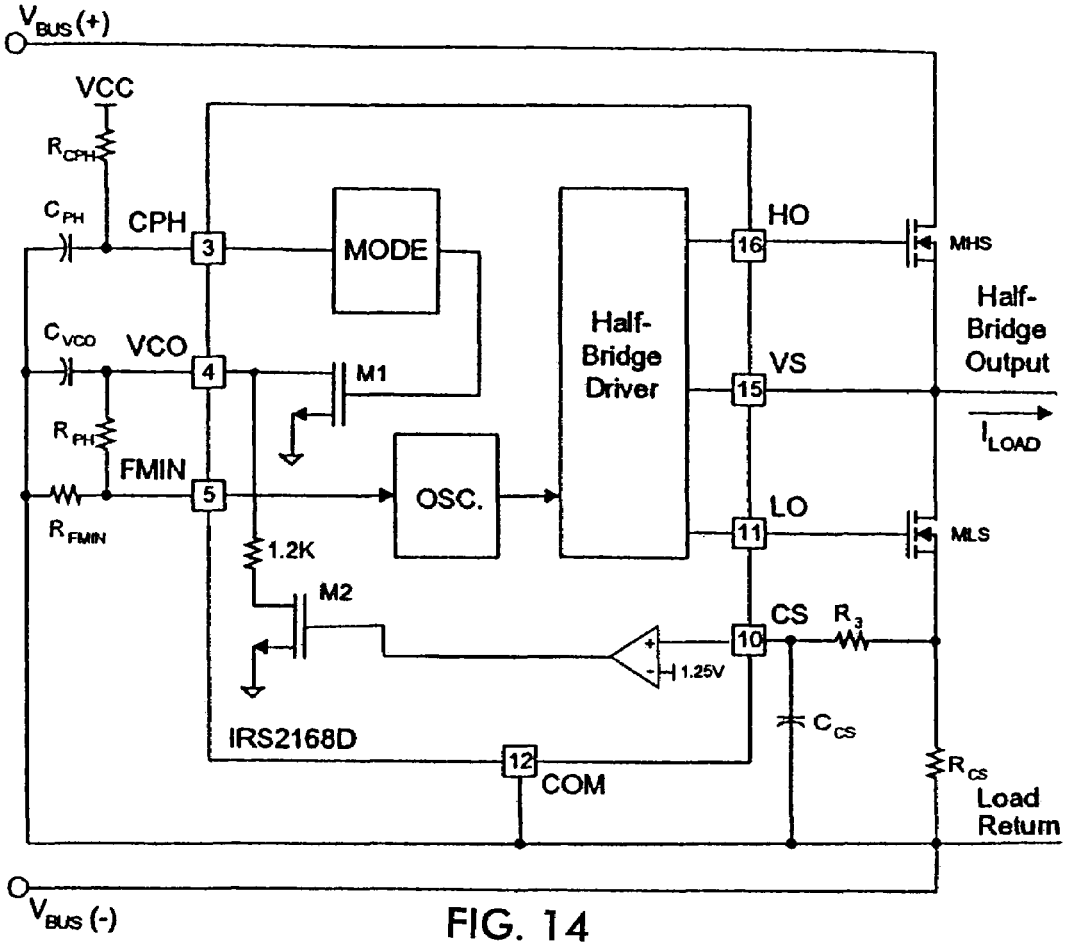
FIG. 14 shows ignition circuitry.

The IRS2168D ignition mode is defined by the second time CPH charges from ⅓*VCC to ⅔*VCC. When the voltage on pin CPH exceeds ⅔*VCC for the first time, pin CPH is discharged quickly through an internal MOSFET down to ⅓*VCC (see FIGS. 13 and 14). The internal MOSFET turns off and the voltage on pin CPH begins to increase again. The internal MOSFET at pin VCO turns off and resistor RPH is disconnected from COM. The equivalent resistance at the FMIN pin increases from the parallel combination (RPH//RFMIN) to RFMIN at a rate programmed by the external capacitor at pin VCO (CVCO) and resistor RPH. This causes the operating frequency to ramp down smoothly from the preheat frequency through the ignition frequency to the final run frequency. During this ignition ramp, the frequency sweeps through the resonance frequency of the lamp output stage to ignite the lamp.

Figure 15:
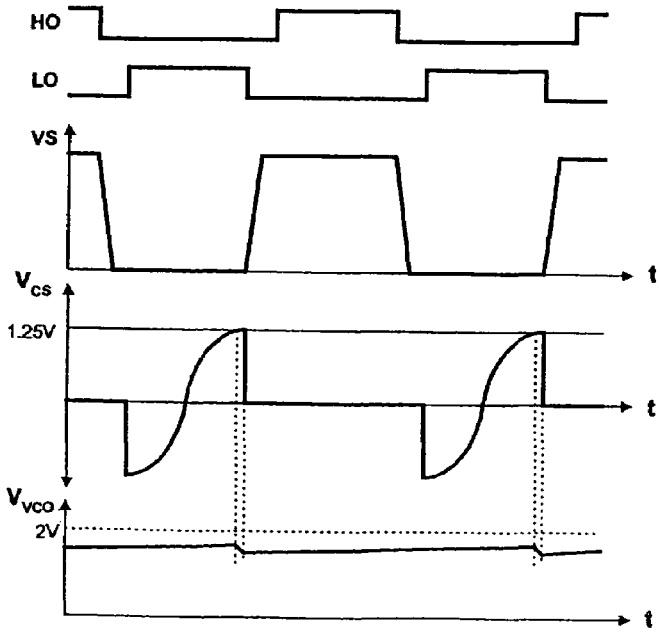
FIG. 15 is a timing diagram relative to ignition regulation.

The over-current threshold on pin CS will protect the ballast against a non-strike or open-filament lamp fault condition. The voltage on pin CS is defined by the lower half-bridge MOSFET current flowing through the external current sensing resistor RCS. This resistor programs the maximum peak ignition current (and therefore peak ignition voltage) of the ballast output stage. Should this voltage exceed the internal threshold of 1.25V, the ignition regulation circuit discharges the VCO voltage slightly to increase the frequency slightly (see FIG. 15). This cycle-by-cycle feedback from the CS pin to the VCO pin will adjust the frequency each cycle to limit the amplitude of the current for the entire duration of ignition mode. When CPH exceeds ⅔*VCC for the second time, the IC enters run mode and the fault counter becomes enabled. The ignition regulation remains active in run mode but the IC will enter fault mode after 60 consecutive over-current faults and gate driver outputs HO, LO and PFC will be latched low. During ignition mode, the PFC circuit is working in high-gain mode and keeps the DC bus voltage regulated at a constant level. The high-gain mode prevents the DC bus from decreasing during lamp ignition or ignition regulation.

Run Mode (RUN)

Once VCC has exceeded ⅔*VCC for the second time, the IC enters run mode. CPH continues to charge up to VCC. The operating frequency is at the minimum frequency (after the ignition ramp) and is programmed by the external resistor (RFMIN) at the FMIN pin. Should hard-switching occur at the half-bridge at any time (open-filament, lamp removal, etc.), the voltage across the current sensing resistor (RCS) will exceed the internal threshold of 1.25 volts and the fault counter will begin counting (see FIG. 14). Should the number of consecutive over-current faults exceed 60, the IC will enter fault mode and the HO, LO and PFC gate driver outputs will be latched low. During run mode, the end-of-life (EOL) window comparator and the DC bus under-voltage reset are both enabled.

DC Bus Under-Voltage Reset

Should the DC bus decrease too low during a brown-out line condition or over-load condition, the resonant output stage to the lamp can shift near or below resonance. This can produce hard switching at the half-bridge that can damage the half-bridge switches, or, the DC bus can decrease too far and the lamp can extinguish. To protect against this, the VBUS pin includes a 3.0V under-voltage reset threshold. When the IC is in run mode and the voltage at the VBUS pin decreases below 3.0V, VCC will be discharged through an internal MOSFET down to the UVLO− threshold and all gate driver outputs will be latched low. For proper ballast design, the designer should set the over-current limit of the PFC section such that the DC bus does not drop until the AC line input voltage falls below the minimum rated input voltage of the ballast (see PFC section). When the PFC over-current limit is correctly set, the DC bus voltage will start to decrease when over-current is reached during low-line conditions. The voltage measured at the VBUS pin will decrease below the internal 3.0V threshold and the ballast will turn off cleanly. The pull-up resistor to VCC ($R_{VCC}$) will then turn the ballast on again when the AC input line voltage increases high enough again where VCC exceeds UVLO+. $R_{VCC}$ should be set to turn the ballast on at the minimum specified ballast input voltage and the PFC over-current should be set somewhere below this level. This hysteresis will result in clean turn-on and turn-off of the ballast.

SD/EOL and CS Fault Mode

Should the voltage at the SD/EOL pin exceed 3V or decrease below 1V during run mode, an end-of-life (EOL) fault condition has occurred and the IC enters fault mode. LO, HO and PFC gate driver outputs are all latched off in the 'low' state. CPH is discharged to COM for resetting the preheat time and VCO is discharged to COM for resetting the frequency. To exit fault mode, VCC can be decreased below UVLO− (ballast power off) or the SD pin can be increased above 5V (lamp removal). Either of these will force the IC to enter UVLO mode (see State Diagram, FIG. 5). Once VCC is above UVLO+ (ballast power on) and SD is pulled above 5V and back below 3V (lamp re-insertion), the IC will enter preheat mode and begin oscillating again.

Figure 16:
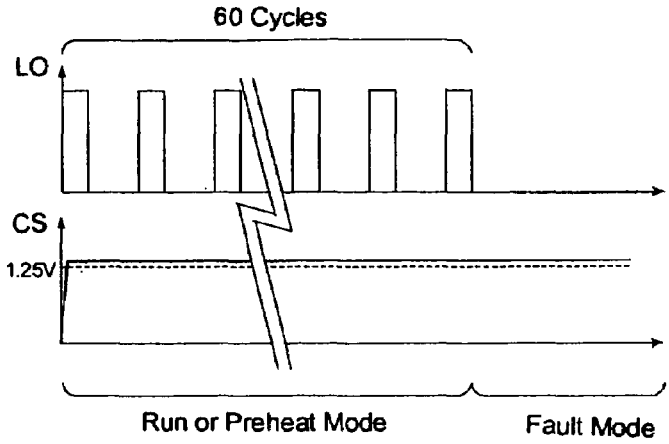
FIG. 16 is a timing diagram for the fault counter.

The current sense function will force the IC to enter fault mode only after the voltage at the CS pin has been greater than 1.25V for 60 consecutive cycles of LO. The voltage at the CS pin is AND-ed with LO (see FIG. 16) so it will work with pulses that occur during the LO on-time or DC. If the over-current faults are not consecutive, then the internal fault counter will count down each cycle when there is no fault. Should an over-current fault occur only for a few cycles and then not occur again, the counter will eventually reset to zero. The over-current fault counter is enabled during preheat and run modes and disabled during ignition mode.

Ballast Design Equations

Note: The results from the following design equations can differ slightly from actual measurements due to IC tolerances, component tolerances, and oscillator over- and undershoot due to internal comparator response time.

Step 1: Program Run Frequency

The run frequency is programmed with the timing resistor RFMIN at the FMIN pin. The run frequency is given as:

$$f_{RUN} = \frac{1}{(4.8e-10)\cdot R_{FMIN}} \text{ [Hertz] or} \tag{1}$$

$$R_{FMIN} = \frac{1}{(4.8e-10)\cdot f_{RUN}} \text{ [Ohms] or} \tag{2}$$

Figure 23:
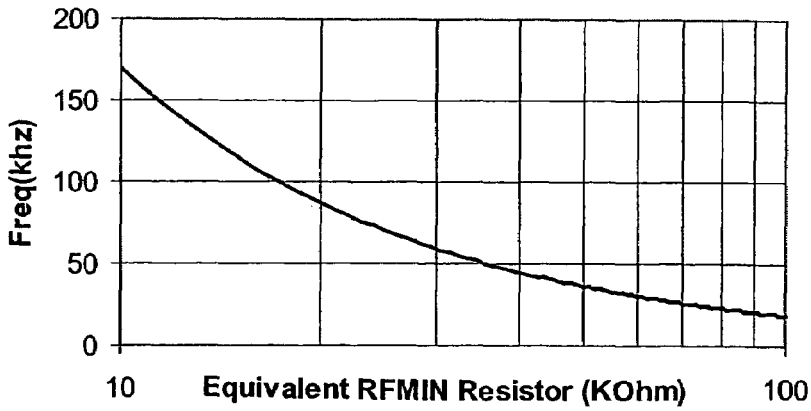
FIG. 23 is a graph of RFMIN vs. frequency for use in selecting component values.

Use a graph of RFMIN vs. Frequency (FIG. 23) to select RFMIN value for desired run frequency.

Step 2: Program Preheat Frequency

The preheat frequency is programmed with timing resistors RFMIN and RPH. The timing resistors are connected in parallel for the duration of the preheat time. The preheat frequency is therefore given as:

$$f_{PH} = \frac{R_{FMIN} + R_{PH}}{(4.8e-10)\cdot R_{FMIN}\cdot R_{PH}} \text{ [Hertz] or} \tag{3}$$

$$R_{PH} = \frac{R_{FMIN}}{(4.8e-10)\cdot R_{FMIN}\cdot f_{PH} - 1} \text{ [Ohms] or} \tag{4}$$

Use a graph of RFMIN vs. Frequency (FIG. 23) to select REQUIV value for desired preheat frequency. Then RPH is given as:

$$R_{PH} = \frac{R_{FMIN}\cdot R_{EQUIV}}{R_{FMIN} - R_{EQUIV}} \text{ [Ohms]} \tag{5}$$

Step 3: Program Preheat Time

The preheat time is defined by the time it takes for the external capacitor on pin CPH to charge up to ⅔*VCC. An external resistor (RCPH) connected to VCC charges capacitor CPH. The preheat time is therefore given as:

$$t_{PH} = R_{CPH} \cdot C_{PH} \text{ [Seconds] or} \quad (6)$$

$$C_{PH} = \frac{t_{PH}}{R_{CPH}} \text{ [Farads]} \quad (7)$$

Step 4: Program Ignition Ramp Time

The ramp time is defined by the time it takes for the external capacitor on pin VCO to charge up to 2V. The external timing resistor (RPH) connected to FMIN charges capacitor CVCO. The ignition ramp time is therefore given as:

$$t_{RAMP} = R_{PH} \cdot C_{VCO} \text{ [Seconds] or} \quad (6)$$

$$C_{VCO} = \frac{t_{RAMP}}{R_{PH}} \text{ [Farads]} \quad (7)$$

Step 5: Program Maximum Ignition Current

The maximum ignition current is programmed with the external resistor RCS and an internal threshold of 1.25V. This threshold determines the over-current limit of the ballast, which will be reached when the frequency ramps down towards resonance during ignition and the lamp does not ignite. The maximum ignition current is given as:

$$I_{IGN} = \frac{1.25}{R_{CS}} \text{ [Amps Peak] or} \quad (9)$$

$$R_{CS} = \frac{1.25}{I_{IGN}} \text{ [Ohms]} \quad (10)$$

PFC Design Equations

Step 1: Calculate PFC Inductor Value:

$$L_{PFC} = \frac{(VBUS - \sqrt{2} \cdot VAC_{MIN}) \cdot VAC_{MIN}^2 \cdot \eta}{2 \cdot f_{MIN} \cdot P_{OUT} \cdot VBUS} \text{ [Henries] where,} \quad (1)$$

$VBUS$ = DC bus voltage $VAC_{MIN}$ = Minimum rms AC input voltage $\eta$ = $PFC$ efficiency (typically 0.95)

$f_{MIN}$ =

Minimum $PFC$ switching frequency at minimum AC input voltage $P_{OUT}$ = Ballast output power Step 2: Calculate Peak PFC Inductor Current:

$$i_{PK} = \frac{2 \cdot \sqrt{2} \cdot P_{OUT}}{VAC_{MIN} \cdot \eta} \text{ [Amps Peak]} \quad (2)$$

Note: The PFC inductor must not saturate at $i_{PK}$ over the specified ballast operating temperature range. Proper core sizing and air-gapping should be considered in the inductor design.

Step 3: Calculate PFC Over-Current Resistor ROC Value:

$$R_{OC} = \frac{1.25}{i_{PK}} \text{ [Ohms]} \quad (3)$$

Step 4: Calculate Start-Up Resistor RVCC Value:

$$R_{VCC} = \frac{VAC_{MIN_{PK}} + 10}{IQCCUV} \text{ [Ohms]} \quad (4)$$

PFC Section

In most electronic ballasts it is highly desirable to have the circuit act as a pure resistive load to the AC input line voltage. The degree to which the circuit matches a pure resistor is measured by the phase shift between the input voltage and input current and how well the shape of the input current waveform matches the shape of the sinusoidal input voltage. The cosine of the phase angle between the input voltage and input current is defined as the power factor (PF), and how well the shape of the input current waveform matches the shape of the input voltage is determined by the total harmonic distortion (THD). A power factor of 1.0 (maximum) corresponds to zero phase shift and a THD of 0% and represents a pure sinusoidal waveform (no distortion). For this reason it is desirable to have a high PF and a low THD. To achieve this, the IR2168D includes an active power factor correction (PFC) circuit.

Figure 17:
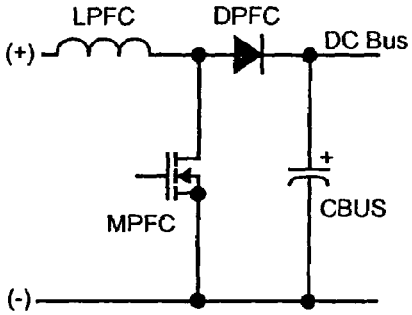
FIG. 17 is a schematic diagram of a boost converter.

The control method implemented in the IR2168D is for a boost-type converter (FIG. 17) running in critical-conduction mode (CCM). This means that during each switching cycle of the PFC MOSFET, the circuit waits until the inductor current discharges to zero before turning the PFC MOSFET on again. The PFC MOSFET is turned on and off at a much higher frequency (>10 KHz) than the line input frequency (50 to 60 Hz).

Figure 18:
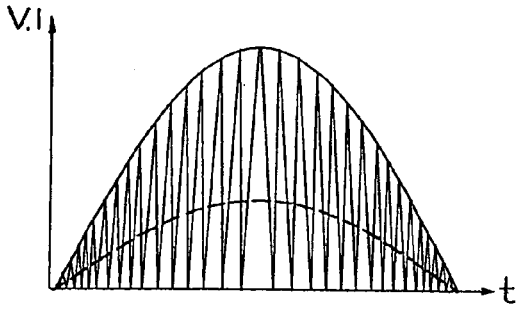
FIG. 18 is a graph showing sinusoidal line input voltage (solid line), smoothed sinusoidal line input current (dashed line), and triangular PFC inductor current, over one-half cycle of the line input voltage.

When the switch MPFC is turned on, the inductor LPFC is connected between the rectified line input (+) and (−) causing the current in LPFC to charge up linearly. When MPFC is turned off, LPFC is connected between the rectified line input (+) and the DC bus capacitor CBUS (through diode DPFC) and the stored current in LPFC flows into CBUS. MPFC is turned on and off at a high frequency and the voltage on CBUS charges up to a specified voltage. The feedback loop of the IR2168D regulates this voltage to a fixed value by continuously monitoring the DC bus voltage and adjusting the on-time of MPFC accordingly. For an increasing DC bus the on-time is decreased, and for a decreasing DC bus the on-time is increased. This negative feedback control is performed with a slow loop speed and a low loop gain such that the average inductor current smoothly follows the low-frequency line input voltage for high power factor and low THD. The on-time of MPFC therefore appears to be fixed (with an additional modulation to be discussed later) over several cycles of the line voltage. With a fixed on-time, and an off-time determined by the inductor current discharging to zero, the result is a system where the switching frequency is free-running and constantly changing from a high frequency near the zero crossing of the AC input line voltage, to a lower frequency at the peaks (FIG. 18).

When the line input voltage is low (near the zero crossing), the inductor current will charge up to a small amount and the discharge time will be fast resulting in a high switching frequency. When the input line voltage is high (near the peak), the inductor current will charge up to a higher amount and the discharge time will be longer giving a lower switching frequency.

Figure 19:
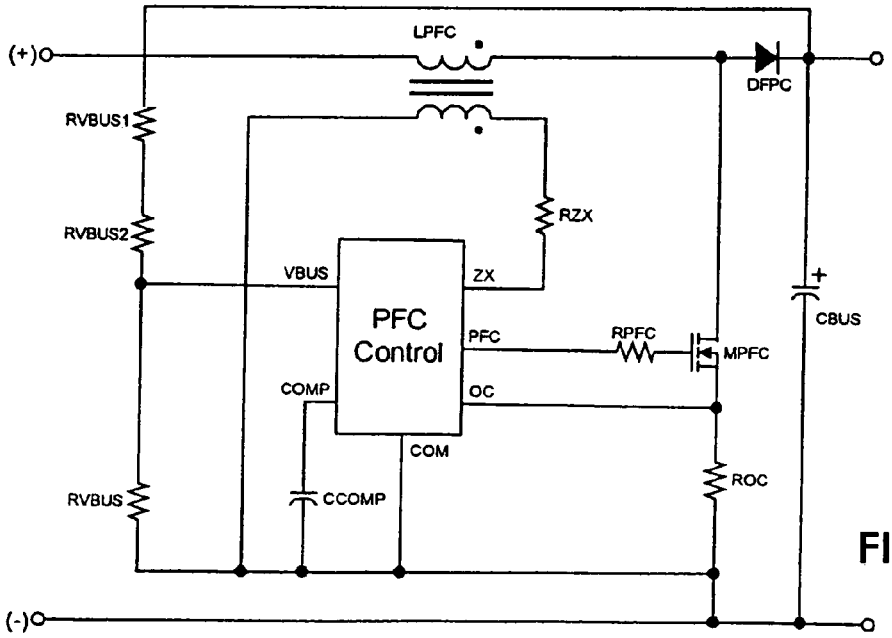
FIG. 19 is a simplified schematic of a PFC control circuit.

The PFC control circuit of the IR2168D (FIG. 19) includes five control pins: VBUS, COMP, ZX, PFC and OC. The VBUS pin measures the DC bus voltage via an external resistor voltage divider. The COMP pin programs the on-time of MPFC and the speed of the feedback loop with an external capacitor. The ZX pin detects when the inductor current discharges to zero each switching cycle using a secondary winding from the PFC inductor. The PFC pin is the low-side gate driver output for the external MOSFET, MPFC. The OC pin senses the current flowing through MPFC and performs cycle-by-cycle over-current protection.

Figure 20:
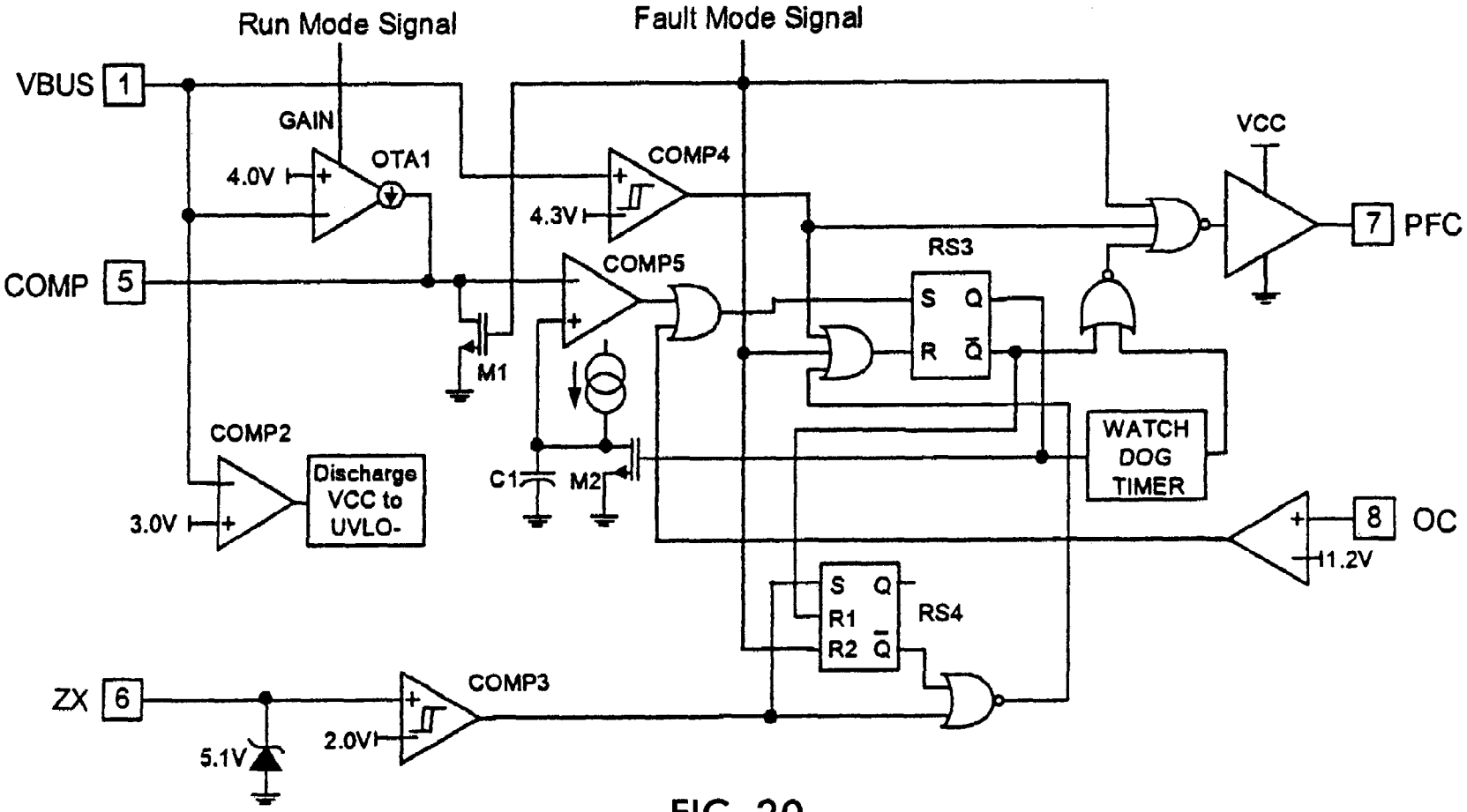
FIG. 20 is a detailed block diagram of the PFC control circuit.

The VBUS pin is regulated against a fixed internal 4V reference voltage for regulating the DC bus voltage (FIG. 20). The feedback loop is performed by an operational transconductance amplifier (OTA) that sinks or sources a current to the external capacitor at the COMP pin. The resulting voltage on the COMP pin sets the threshold for the charging of the internal timing capacitor (C1, FIG. 20) and therefore programs the on-time of MPFC. During preheat and ignition modes of the ballast section, the gain of the OTA is set to a high level to raise the DC bus level quickly and to minimize the transient on the DC bus that can occur during ignition. During run mode, the gain is then decreased to a lower level necessary for a slower loop speed for achieving high power factor and low THD.

Figure 21:
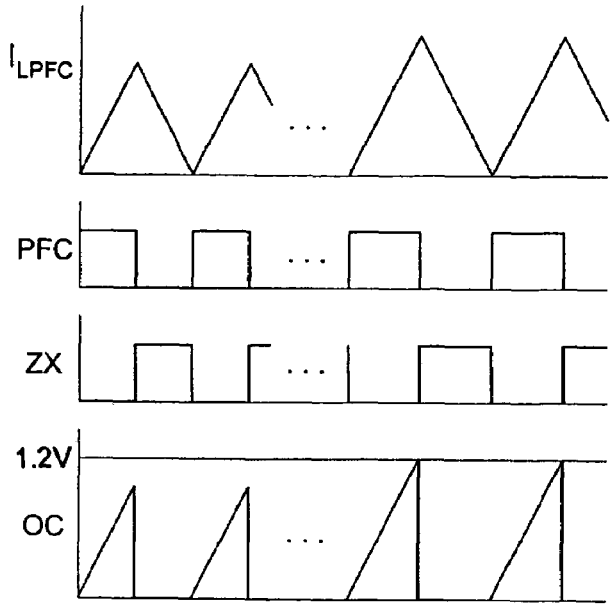
FIG. 21 is a timing diagram showing inductor current, and PFC pin, ZX pin and OC pin signals.

The off-time of MPFC is determined by the time it takes the LPFC current to discharge to zero. The zero current level is detected by a secondary winding on LPFC that is connected to the ZX pin through an external current limiting resistor RZX. A positive-going edge exceeding the internal 2V threshold signals the beginning of the off-time. A negative-going edge on the ZX pin falling below 1.7V will occur when the LPFC current discharges to zero which signals the end of the off-time and MPFC is turned on again (FIG. 21). The cycle repeats itself indefinitely until the PFC section is disabled due to a fault detected by the ballast section (Fault Mode), an over-voltage or under-voltage condition on the DC bus, or, the negative transition of ZX pin voltage does not occur. Should the negative edge on the ZX pin not occur, MPFC will remain off until the watch-dog timer forces a turn-on of MPFC for an on-time duration programmed by the voltage on the COMP pin. The watch-dog pulses occur every 400 μs indefinitely until a correct positive- and negative-going signal is detected on the ZX pin and normal PFC operation is resumed. Should the OC pin exceed the 1.2V over-current threshold during the on-time, the PFC output will turn off. The circuit will then wait for a negative-going transition on the ZX pin or a forced turn-on from the watch-dog timer to turn the PFC output on again.

On-Time Modulation Circuit

Figure 22:
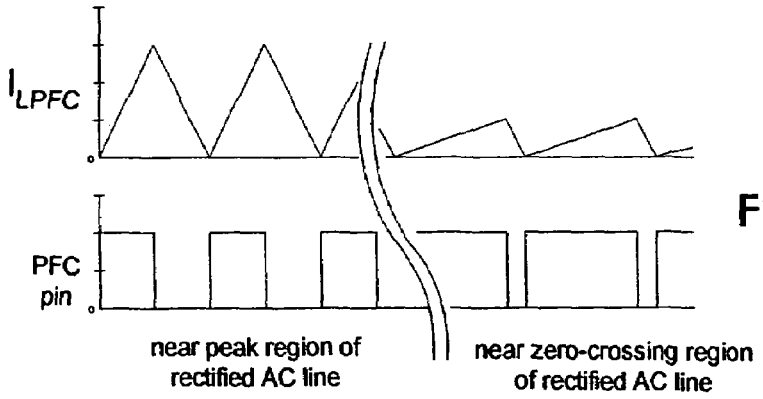
FIG. 22 is a timing diagram showing on-time modulation near the AC line zero-crossings.

A fixed on-time of MPFC over an entire cycle of the line input voltage produces a peak inductor current which naturally follows the sinusoidal shape of the line input voltage. The smoothed averaged line input current is in phase with the line input voltage for high power factor but the total harmonic distortion (THD), as well as the individual higher harmonics, of the current can still be too high. This is mostly due to cross-over distortion of the line current near the zero-crossings of the line input voltage. To achieve low harmonics which are acceptable to international standard organizations and general market requirements, an additional on-time modulation circuit has been added to the PFC control. This circuit dynamically increases the on-time of MPFC as the line input voltage nears the zero-crossings (FIG. 22). This causes the peak LPFC current, and therefore the smoothed line input current, to increase slightly higher near the zero-crossings of the line input voltage. This reduces the amount of cross-over distortion in the line input current which reduces the THD and higher harmonics to low levels.

DC Bus Over-Voltage Protection (OVP)

Should over-voltage occur on the DC bus and the VBUS pin exceeds the internal 4.3V threshold, the PFC output is disabled (set to a logic 'low'). When the DC bus decreases again and the VBUS pin decreases below the internal 4.15V threshold, a watch-dog pulse is forced on the PFC pin and normal PFC operation is resumed.

DC Bus Under-Voltage Reset

When the input line voltage decreases, the on-time of MPFC increases to keep the DC bus constant. The on-time will continue to increase as the line voltage continues to decrease until the OC pin exceeds the internal 1.2V over-current threshold. At this time, the on-time can no longer increase and the PFC can no longer supply enough current to keep the DC bus fixed for the given load power. This will cause the DC bus to begin to decrease. The decreasing DC bus will cause the VBUS pin to decrease below the internal 3V threshold (FIG. 20). When this occurs, VCC is discharged internally to UVLO−. The IR2168D enters UVLO mode and both the PFC and ballast sections are disabled. The start-up supply resistor to VCC, together with the micro-power start-up current, should be set such that the ballast turns on at an AC line input voltage above the level at which the DC bus begins to drop. The current-sensing resistor at the OC pin sets the maximum PFC current and therefore sets the maximum on-time of MPFC. This prevents saturation of the PFC inductor and programs the minimum low-line input voltage for the ballast. The micro-power supply resistor to VCC and the current-sensing resistor at the OC pin program the on and off input line voltage thresholds for the ballast. With these thresholds correctly set, the ballast will turn off due to the 3V under-voltage threshold on the VBUS pin, and on again at a higher voltage (hysteresis) due to the supply resistor to VCC.

Although the present invention has been described in relation to particular embodiments thereof, many other variations and modifications and other uses will become apparent to those skilled in the art. Therefore, the present invention is not limited by the specific disclosure herein.

What is claimed is:

1. An IC for controlling a power supply circuit for delivering power to a load circuit including a fluorescent lamp resonant output stage, comprising:

ballast control and driver circuitry that provides drive signals to the power supply circuit, receives current sense signals indicative of current in said output stage, and responds to the current sense signals by modifying the drive signals;

the ballast control and driver circuitry including:

drive circuitry that provides the drive signals; and fault detection circuitry that receives the current sense signals and provides a detect signal in response to an overcurrent fault in the output stage, wherein each detect signal corresponds to an overcurrent condition coinciding with one of said drive signals, and in response to said detect signal, causes the drive circuitry to cease providing the drive signals;

wherein said fault detection circuitry comprises an internal fault counter that delays termination of said drive signals until a predetermined number of consecutive detect signals have been counted; and wherein said internal fault counter reduces its count of detect signals when a drive signal does not coincide with an overcurrent condition in the output stage.

2. The IC of claim 1, wherein said ballast control and driver circuitry has a plurality of operating modes including preheat, ignition and run modes, said fault detection circuitry being enabled in the ignition and run modes, and responding to a single detect signal for terminating the drive signals.

3. The IC of claim 2, wherein said fault detection circuitry is disabled in the preheat mode.

4. The IC of claim 1, wherein said ballast control and driver circuitry has a plurality of operating modes including preheat, ignition and run modes, said fault detection circuitry being enabled in the preheat and run modes, and comprising an internal fault counter that delays termination of said drive signals until a predetermined number of detect signals have been counted.

5. The IC of claim 4, wherein said predetermined number is 60.

6. The IC of claim 1, wherein said ballast control and driver circuitry has a plurality of operating modes including preheat, ignition and run modes, said fault detection circuitry being disabled in said ignition mode, said ballast control and driver circuitry further comprising an ignition current regulation circuit which provides a regulated current to said output stage for a predetermined time in said ignition mode, and terminates said drive signals if ignition does not occur during the predetermined time.

7. The IC of claim 6, wherein said predetermined time is ½ second.

8. The IC of claim 1, wherein said ballast control and driver circuitry has a plurality of operating modes including preheat and ignition modes;

further comprising a timing capacitor and a circuit for charging said capacitor;

said ballast control and driver circuitry remaining in preheat mode until said timing capacitor is charged to a first predetermined voltage, then discharging said capacitor to a second predetermined voltage, then remaining in ignition mode until said capacitor again reaches said first predetermined voltage.

9. The IC of claim 8, wherein said first and second predetermined voltages are respectively ⅔ and ⅓ of an IC supply voltage.

10. The IC of claim 8, wherein said IC has an internal switching circuit for rapidly discharging said timing capacitor from said first to said second predetermined voltage.

11. The IC of claim 10, wherein said timing capacitor and charging circuit are external of said IC.

12. The IC of claim 8, wherein said timing capacitor and charging circuit are external of said IC.

13. The IC of claim 8, wherein the duration of said preheat mode is approximately twice the duration of the ignition mode.

14. The IC of claim 1, wherein said ballast control and driver circuitry has a plurality of operating modes including preheat, ignition and run modes;

wherein said drive circuitry comprises a variable frequency oscillator providing said drive signals, the operating frequency of the oscillator being responsive to a current at an FMIN pin of said IC, said FMIN pin being connected to a voltage source and to said oscillator;

in the run mode, said current being determined by said voltage source and a resistor RFMIN connected to said FMIN pin.

15. The IC of claim 14, wherein said current is determined in the preheat mode by the parallel combination of the RFMIN resistor and a resistor RPH which is connected to the FMIN pin and to a pin VCO of said IC, said IC having an internal switch connected to the pin VCO which is open in run mode for disconnecting RPH but closed in preheat mode for connecting RPH in parallel with RFMIN.

16. The IC of claim 15, further comprising a capacitor CVCO connected to the pin VCO and providing a variable voltage at the VCO pin for varying the frequency range between a maximum frequency in preheat mode to a minimum frequency in run mode.

17. The IC of claim 16, wherein said frequency range includes a resonance frequency for igniting the lamp.

18. The IC of claim 1, wherein said ballast control and driver circuitry comprises an end-of-life (EOL) window comparator which receives a lamp voltage signal at an BOL pin and generates an BOL fault signal when said lamp voltage is greater or less than a predetermined range; and further comprising a bias circuit connected to the EOL pin for biasing said lamp voltage signal at an intermediate level within said predetermined range.

19. The IC of claim 18, wherein said bias circuit comprises an operational transconductance amplifier referenced to a reference voltage at said intermediate level.

20. The IC of claim 18, wherein said predetermined range is about 1 to 3V and said intermediate level is about 2V.

21. The IC of claim 1, further comprising power factor correction (PFC) circuitry which regulates a DC bus voltage which is provided to the resonant output stage;

said PFC circuitry comprising a switching device; and an overcurrent circuit for detecting current in said PFC circuitry, and when said current exceeds a predetermined level, controlling said switching device to limit said current.

22. The IC of claim 21, wherein said overcurrent circuit is operative to limit said current cycle-by-cycle of a PFC switching period.

23. The IC of claim 1, wherein said output stage comprises a semiconductor switch driven by said drive circuitry, and wherein said current sense signals are indicative of current through said semiconductor switch.

24. The IC of claim 1, wherein said fault detection circuitry responds to a single detect signal for terminating said drive signals.

25. A method of controlling a power supply circuit for delivering power to a load circuit including a fluorescent lamp resonant output stage, comprising the steps of:

providing drive signals to the power supply circuit, receiving current sense signals indicative of current in said output stage, and responding to the current sense signals by modifying the drive signals;

receiving the current sense signals and providing a detect signal in response to an overcurrent fault in the output stage, wherein each detect signal corresponds to an overcurrent condition coinciding with one of said drive signals, and in response to said detect signal, causing the drive circuitry to cease providing the drive signals; and employing an internal fault counter to delay termination of said drive signals until a predetermined number of consecutive detect signals have been counted;

wherein said internal fault counter reduces its count of detect signals when a drive signal does not coincide with an overcurrent condition in the output stage.

26. The method of claim 25, further comprising providing a plurality of operating modes including preheat, ignition and run modes, and at least during said ignition and run modes, responding to a single detect signal for terminating the drive signals.

27. The method of claim 25, further comprising providing a plurality of operating modes including preheat, ignition and run modes, and at least in the preheat and run modes, counting said detect signals to delay termination of said drive signals until a predetermined number of detect signals have been counted.

28. The method of claim 27, wherein said predetermined number is 60.

29. The method of claim 25, further comprising providing a plurality of operating modes including preheat, ignition and run modes, and providing ignition current regulation to provide a regulated current to said output stage for a predetermined time in said ignition mode, and terminating said drive signals if ignition does not occur during the predetermined time.

30. The method of claim 29, wherein said predetermined time is ½ second.

31. The method of claim 25, further comprising:

providing a plurality of operating modes including preheat and ignition modes;

providing a timing capacitor and a circuit for charging said capacitor;

remaining in preheat mode until said timing capacitor is charged to a first predetermined voltage, then discharging said capacitor to a second predetermined voltage, then remaining in ignition mode until said capacitor again reaches said first predetermined voltage.

32. The method of claim 31, wherein said first and second predetermined voltages are respectively ⅔ and ⅓ of an IC supply voltage.

33. The method of claim 31, further rapidly discharging said timing capacitor from said first to said second predetermined voltage.

34. The method of claim 31, wherein the duration of said preheat mode is approximately twice the duration of the ignition mode.

35. The method of claim 25, further comprising:

providing a plurality of operating modes including preheat, ignition and run modes;

generating a variable frequency for providing said drive signals, the frequency being responsive to a current at an FMIN pin, and connecting said FMIN pin to a voltage source, in the run mode, determining said current by a connecting resistor RFMIN to said FMIN pin.

36. The method of claim 35, wherein said current is determined in the preheat mode by the parallel combination of the RFMIN resistor and a resistor RPH which is connected to the FMIN pin and to a pin VCO of said IC, said IC having an internal switch connected to the pin VCO which is open in run mode for disconnecting RPH but closed in preheat mode for connecting RPH in parallel with RFMIN.

37. The method of claim 36, further comprising connecting a capacitor CVCO to the pin VCO for providing a variable voltage at the VCO pin for varying the frequency range between a maximum frequency in preheat mode to a minimum frequency in run mode.

38. The method of claim 37, wherein said frequency range includes a resonance frequency for igniting the lamp.

39. The method of claim 25, further comprising:

receiving a lamp voltage signal at an end-of-life (EOL) window comparator and generating an EOL fault signal when said lamp voltage is greater or less than a predetermined range; and biasing said lamp voltage signal at an intermediate level within said predetermined range.

40. The method of claim 39, wherein said predetermined range is about 1 to 3V and said intermediate level is about 2V.

41. The method of claim 25, further comprising:

correcting a power factor by regulating a DC bus voltage which is provided to the resonant output stage by PFC circuitry comprising a switching device; and detecting current in said PFC circuitry, and when said current exceeds a predetermined level, controlling said switching device to limit said current.

42. The method of claim 41, further comprising the step of limiting said current cycle-by-cycle of a PFC switching period.

43. The method of claim 25, wherein said output stage comprises a semiconductor switch driven by said drive circuitry, and wherein said current sense signals are indicative of current through said semiconductor switch.

* * * * *